US008794796B2

(12) United States Patent
Lee

(10) Patent No.: US 8,794,796 B2
(45) Date of Patent: Aug. 5, 2014

(54) CONFIGURABLE MULTI-SOCKET WITH THERMAL RELIEF FOR LIGHT EMITTING DIODES

(75) Inventor: Jershyang Jerry Lee, Memphis, TN (US)

(73) Assignee: Crestview Collection

( * ) Notice: Subject to any disclaimer, the term of this patent is extended or adjusted under 35 U.S.C. 154(b) by 0 days.

(21) Appl. No.: 13/211,207

(22) Filed: Aug. 16, 2011

(65) Prior Publication Data

US 2013/0044486 A1 Feb. 21, 2013

(51) Int. Cl.

| | |
|---|---|
| ***F21V 21/00*** | (2006.01) |
| ***F21V 23/00*** | (2006.01) |
| ***H01R 33/95*** | (2006.01) |
| ***H01R 13/717*** | (2006.01) |
| ***F21K 99/00*** | (2010.01) |
| ***H01R 33/90*** | (2006.01) |
| *F21V 19/04* | (2006.01) |
| *F21Y 113/00* | (2006.01) |
| *F21Y 101/02* | (2006.01) |
| *F21V 21/002* | (2006.01) |

(52) U.S. Cl.

CPC ..... *F21K 9/10* (2013.01); *F21V 23/006* (2013.01); *F21V 19/045* (2013.01); *H01R 33/95* (2013.01); *H01R 13/7175* (2013.01); *F21Y 2113/00* (2013.01); *F21Y 2101/02* (2013.01); *F21V 21/002* (2013.01); *H01R 33/90* (2013.01)

USPC ..... 362/249.16; 362/249.02; 362/249.06; 362/649; 362/653

(58) Field of Classification Search

USPC ..... 362/249.02, 249.06, 249.11, 646, 649, 362/650, 653

See application file for complete search history.

(56) References Cited

U.S. PATENT DOCUMENTS

| | | | | |
|---|---|---|---|---|
| 5,295,055 | A * | 3/1994 | Brock et al. | 362/249.08 |
| 5,655,829 | A * | 8/1997 | Lin et al. | 362/145 |
| 6,241,373 | B1 * | 6/2001 | Kelley et al. | 362/545 |
| 6,502,957 | B1 * | 1/2003 | Klaitman | 362/249.01 |
| 6,932,495 | B2 * | 8/2005 | Sloan et al. | 362/294 |
| 7,086,756 | B2 * | 8/2006 | Maxik | 362/249.04 |
| 7,407,304 | B2 * | 8/2008 | Tasson et al. | 362/249.07 |
| 7,585,090 | B2 * | 9/2009 | Wu | 362/249.02 |
| 8,132,938 | B2 * | 3/2012 | Granqvist | 362/276 |
| 2005/0099810 | A1 * | 5/2005 | Tasson et al. | 362/250 |
| 2011/0222287 | A1 * | 9/2011 | Lee | 362/249.06 |

* cited by examiner

*Primary Examiner* — John A Ward

(57) ABSTRACT

A method and a system are disclosed for using multiple LEDs for lighting applications using a single electrical source, while reducing thermal density to keep the LEDs at a cool operating temperature. In various embodiments, an LED multi-socket may be used to power multiple LEDs. The multi-socket may include two or more socket arms to effectively distribute light and dissipate heat. In some embodiments, the multi-socket is configurable to allow deployment of additional socket arms and corresponding LEDs to adjust maximum light output. In some embodiments, the multi-socket arms are repositionable to allow flexible positioning of LEDs to improve light distribution and to avoid thermal build-up.

7 Claims, 5 Drawing Sheets

CONFIGURABLE MULTI-SOCKET WITH THERMAL RELIEF FOR LIGHT EMITTING DIODES

TECHNICAL FIELD

This application relates generally to lighting. More specifically, this application relates to a method and apparatus for employing multiple Light Emitting Diodes (LED) using a single electrical source.

BRIEF DESCRIPTION OF THE DRAWINGS

The drawings, when considered in connection with the following description, are presented for the purpose of facilitating an understanding of the subject matter sought to be protected.

DETAILED DESCRIPTION

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references LED lighting, it will be appreciated that the disclosure may be applicable to other types of lights, such as incandescent lights, fluorescent lights, and the like.

Briefly described, a method and a system are disclosed for using multiple LEDs for lighting applications using a single electrical source, while reducing thermal density to keep the LEDs at a cool operating temperature. In various embodiments, an LED multi-socket may be used to power multiple LEDs. The multi-socket may include two or more socket arms to effectively distribute light and dissipate heat. In some embodiments, the multi-socket is configurable to allow deployment of additional socket arms and corresponding LEDs to adjust maximum light output. In some embodiments, the multi-socket arms are repositionable to allow flexible positioning of LEDs to improve light distribution and to avoid thermal build-up.

Light emitting diodes (LEDs) are generally more energy efficient light source than standard incandescent light bulbs and fluorescent lights. Currently, the costs of LED based lighting systems increase rapidly with power and light output. However, high power and high light output LEDs may need special thermal diffusion design considerations, because high temperatures may damage or reduce the light output of LEDs. Manufacturing costs tend to be high for LED lights that produce light output comparable to standard household bulbs. Accordingly, adapters or sockets that allow combining output from multiple low-power and low-cost LED lights to produce a desired level total light output is desirable to reduce cost.

Figure 1:
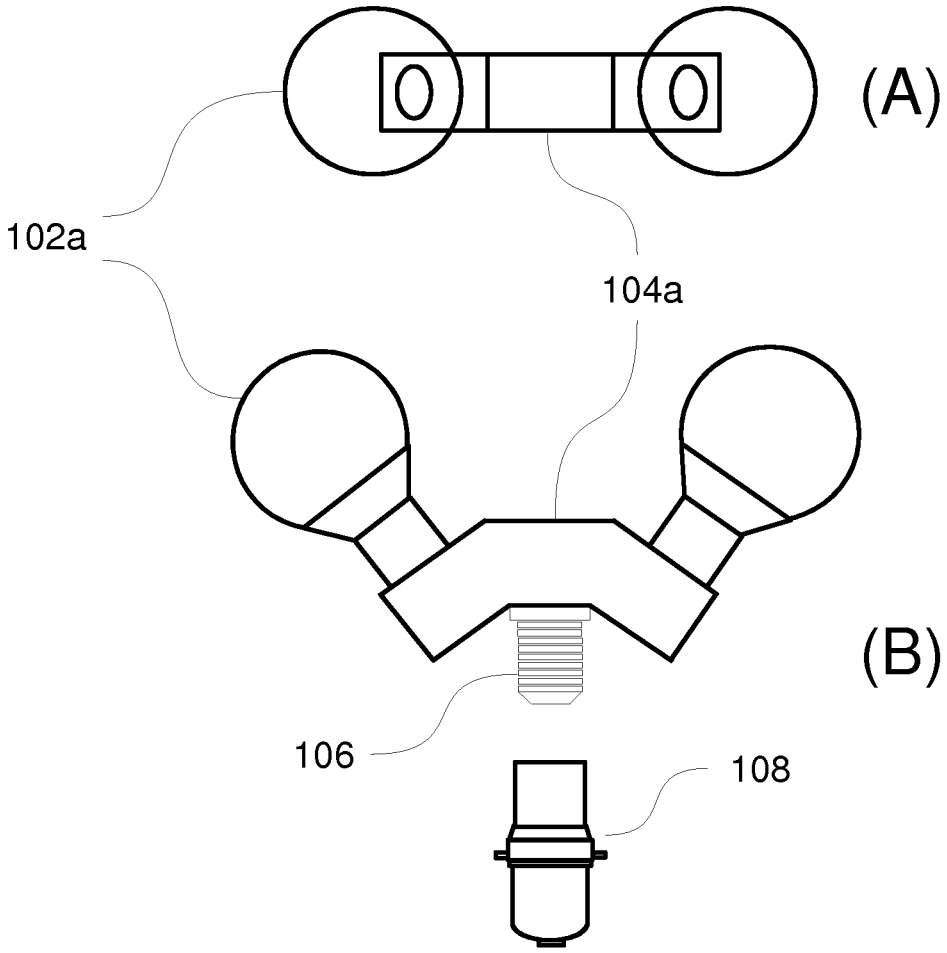
FIGS. 1A and 1B show an example multi-socket for multiple LED lighting applications.

FIGS. 1A and 1B show an example multi-socket for multiple LED lighting applications. In various embodiments, multi-socket substrate 104*a* may be configured to receive two LED bulbs 102*a* via substrate extensions or socket arms having LED sockets. Multi-socket substrate may be coupled to base socket 108 via lamp base 106. FIG. 1A shows a top view of the multi-socket, while FIG. 1B shows a profile view.

In various embodiments, a lamp having a multi-socket allows connecting multiple LED lights to, for example, a single E12 (small) or E27 (large) base socket 108, which may be one of a number of standard socket sizes compatible with general lighting equipment. Base socket 108 provides electrical power to all LEDs in the lamp. The multi-socket arms may be angled, for example, as shown in FIG. 1B, to position its corresponding LED to direct the overall light output in desired directions. Because each individual LED bulb is low power and the socket arms provide separation between the LEDs, no additional thermal diffusion components may be required to maintain safe operating temperatures.

Figure 2:
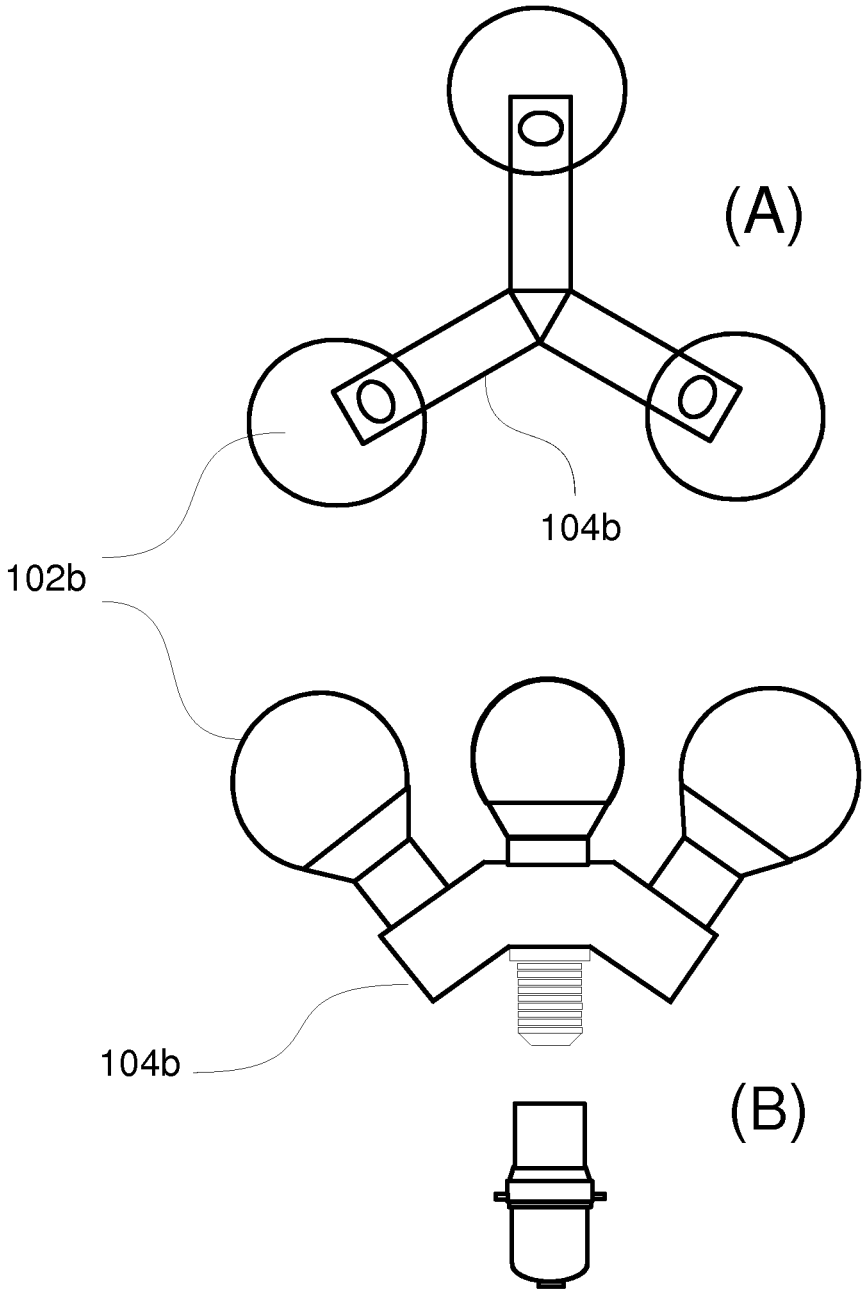
FIGS. 2A and 2B show another example configurable LED multi-socket.

FIGS. 2A and 2B show another example configurable LED multi-socket. In various embodiments, multi-socket substrate 104*b* may be configured to receive three LED bulbs 102*b* via substrate extensions or socket arms having LED sockets. Multi-socket substrate may be coupled to base socket via lamp base, substantially similarly to the embodiment depicted in FIGS. 1A and 1B described above. FIG. 2A shows a top view of the multi-socket, while FIG. 2B shows a profile view.

Figure 3:
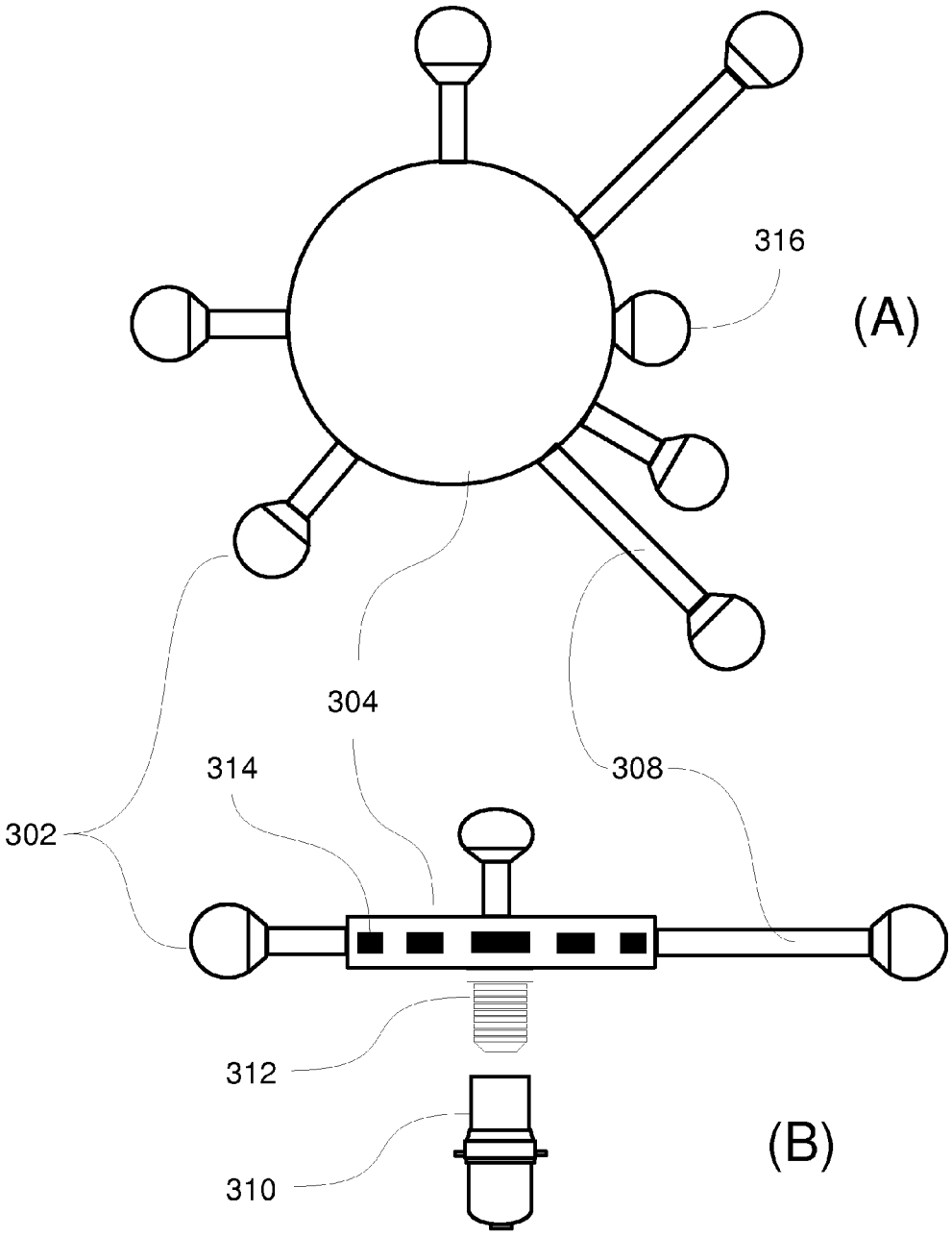
FIGS. 3A and 3B show yet another example configurable LED multi-socket.

FIGS. 3A and 3B show yet another example configurable LED multi-socket. In various embodiments, a lamp having multi-socket disk-shaped substrate 304 may be configured to receive a configurable and variable number of LED bulbs 302 via removable substrate extensions or socket arms 308 having LED sockets. Multi-socket substrate may be coupled to base socket 310 via lamp base 312, substantially similarly to the embodiment depicted in FIGS. 1A and 1B described above. FIG. 3A shows a top view of the multi-socket, while FIG. 3B shows a profile view. Each socket arm 308 may be mechanically and/or electrically coupled with substrate 304 using interface 314. In some embodiments, socket arms 308 may be attached to the substrate by simple plug-in techniques without the use of tools, while in other embodiments, socket arms may be attached or removed by use of tools.

In various embodiments, to adjust maximum total light output from the lamp, additional socket arms 308 may be coupled to substrate 304 via interface 314. In some embodiments, socket arms 308 have different lengths to allow adjusting light distribution and reducing heat density of the lamp by positioning LEDs farther apart from each other, as shown in FIG. 3A.

Those skilled in the art will appreciate that the substrate may have any number of socket arms which physically fit on the substrate, such as two, three, four, five, six, and the like. Those skilled in the art will also appreciate that LED bulbs, such as 316, may be attached to any substrate directly, without any socket arms. Additionally, the cross section and material of the substrate and the socket arms may vary according to design and needs. For example, the cross section of the socket arms may be round, rectangular, or any other shape, and the material may be metal, plastic, wood, and the like.

In some embodiments the LED bulbs may couple to the socket arms and/or the substrate via screw-in interface, while in some other embodiments the LED bulbs may have a push-in base to engage the socket by a pushing action. In such embodiments, the LED bulbs will remain coupled, for example, by the forces resulting from the elasticity of the materials. In other embodiments the socket arms couple with the substrate via screw-in interface and/or via a push-in base.

In such embodiments, the socket arms will remain coupled with the substrate, for example, by the forces resulting from the elasticity of the materials.

Figure 4:
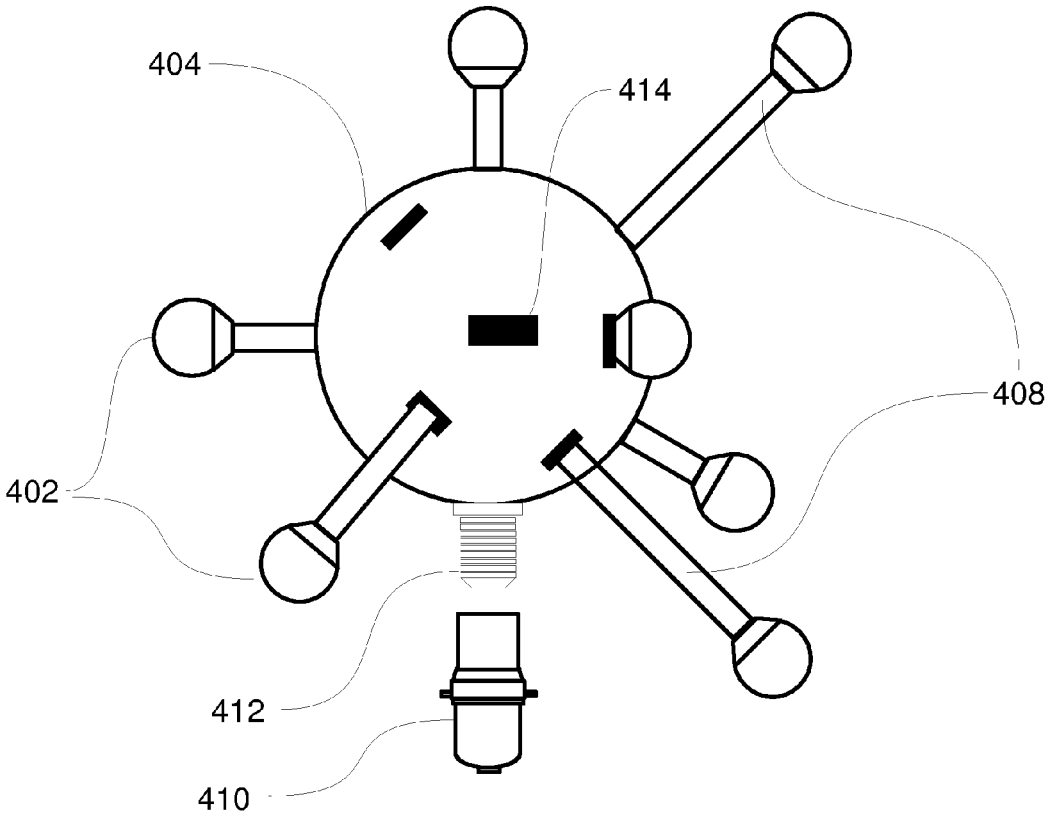
FIG. 4 shows an example configurable spherical LED multi-socket.

FIG. 4 shows an example configurable spherical LED multi-socket. In various embodiments, a lamp having multi-socket spherical substrate 404 may be configured to receive a configurable and variable number of LED bulbs 402 via substrate extensions or socket arms 408 having LED sockets or without socket arms. Multi-socket substrate 404 may be coupled to base socket 410 via lamp base 412. Each socket arm 408 may be mechanically and/or electrically coupled with substrate 404 using interface 414.

In various embodiments, to adjust maximum total light output from the lamp, additional LED bulbs may be coupled to substrate 404 via interface 414, with or without socket arms 408. In some embodiments, socket arms 408 have different lengths to allow adjusting light distribution and reducing heat density of the lamp by positioning LEDs farther apart from each other, as shown. The spherical shape of substrate 404 is highly space-efficient and can provide high light density in a relatively small space.

Figure 5:
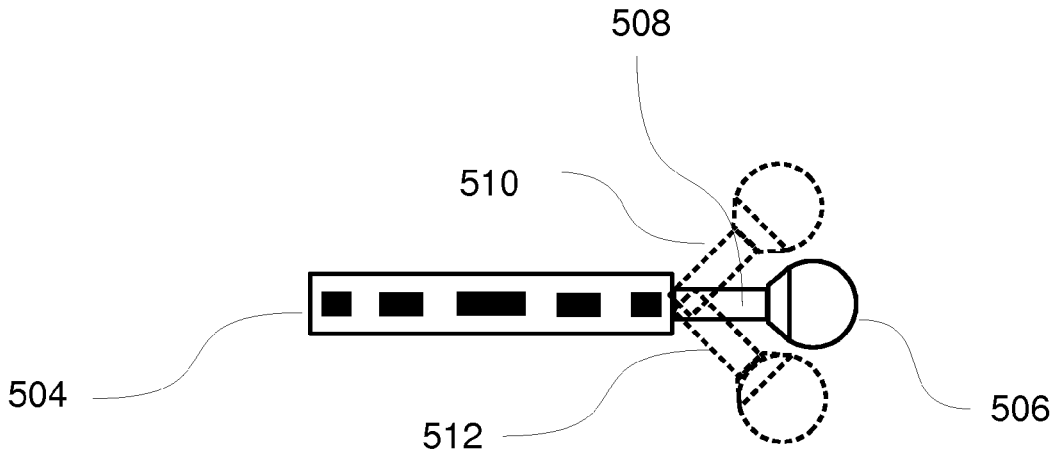
FIG. 5 shows an example repositionable multi-socket arm.

FIG. 5 shows an example repositionable multi-socket arm. In various embodiments, disk-shaped substrate 504 supports LED 506 via socket arm 508 positionable between positions 510 and 512. Repositionable socket arm 508 allows moving LEDs 506 farther apart from each other to reduce thermal density, or moving them closer together to increase light density as desired. Those skilled in the art will appreciate that repositionable socket arm 508 may be used in any of the other embodiments discussed above or other embodiments according to the present disclosure regardless of the substrate shape.

In various embodiments, each socket arm may be configured to receive and couple with more than one LED. In other various embodiments, the substrate and the socket arms are integrated to form one platform for receiving LEDs.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A light socket comprising:

a substrate configured to support a plurality of Light Emitting Diodes (LED) bulbs;

a plurality of different-length removable socket arms, removably coupled with the substrate, wherein heat density and/or light distribution are adjusted by proper arrangement of different-length socket arms, and wherein each socket arm is configured to receive one or more of the plurality of LED bulbs, and wherein each LED bulb couples to one socket arm or directly couples to the substrate via a screw-in interface or a push-in interface, and wherein each socket arm couples with the substrate via a screw-in interface or via a push-in interface; and a lamp base coupled to the substrate and configured to couple to a base socket.

2. The substrate of claim 1, further comprising a plurality of screw-in or push-in interfaces, or both, configured to be coupled to the plurality of removable socket arms.

3. The light socket of claim 1, wherein the socket arms are angled.

4. The light socket of claim 1, wherein the socket arms are repositionable.

5. The light socket of claim 1, wherein the substrate is spherical.

6. The light socket of claim 1, wherein the substrate is disk-shaped.

7. The light socket of claim 1, wherein the substrate is star-shaped.

* * * * *